US008047179B2

(12) United States Patent
Yamada

(10) Patent No.: US 8,047,179 B2
(45) Date of Patent: Nov. 1, 2011

(54) ENGINE UNIT AND VEHICLE INCLUDING THE SAME

(75) Inventor: Takayuki Yamada, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 512 days.

(21) Appl. No.: 12/248,712

(22) Filed: Oct. 9, 2008

(65) Prior Publication Data

US 2009/0095252 A1 Apr. 16, 2009

(30) Foreign Application Priority Data

Oct. 10, 2007 (JP) ..... 2007-264681

(51) Int. Cl.
*F02D 9/10* (2006.01)

(52) U.S. Cl. ..... 123/336; 123/337

(58) Field of Classification Search ..... 123/336, 123/337, 376, 184.31, 198 E, 195 R
See application file for complete search history.

(56) References Cited

U.S. PATENT DOCUMENTS

| | | | | |
|---|---|---|---|---|
| 7,302,929 | B2 * | 12/2007 | Kondo | 123/336 |
| 7,861,687 | B2 * | 1/2011 | Hamasaki et al. | 123/336 |
| 2006/0042589 | A1 * | 3/2006 | Hanasato | 123/336 |
| 2006/0231069 | A1 * | 10/2006 | Hanasato | 123/336 |
| 2007/0023008 | A1 * | 2/2007 | Kondo | 123/336 |

FOREIGN PATENT DOCUMENTS

JP 2002-256900 A 9/2002

* cited by examiner

*Primary Examiner* — Willis Wolfe, Jr.
*Assistant Examiner* — Anthony L Bacon
(74) *Attorney, Agent, or Firm* — Rabin & Berdo, PC

(57) ABSTRACT

An engine unit that has a throttle valve driving actuator securely fixed thereto, and in which the vibration caused on the actuator is small. The engine unit includes a V-type engine and a throttle body assembly. The throttle body assembly has first and second front and rear throttle bodies, an actuator, a transmission gear mechanism, and a casing that houses the actuator and the transmission gear mechanism. The casing has a first casing portion that is fixed to the first front and rear throttle bodies, and a second casing portion that faces the first casing portion in a width direction and is fixed to at least one of the second front and rear throttle bodies.

12 Claims, 13 Drawing Sheets

ENGINE UNIT AND VEHICLE INCLUDING THE SAME

CROSS REFERENCE TO RELATED APPLICATIONS

This application claims the benefit of priority under 35 USC 119 of Japanese patent application no. 2007-264681, filed on Oct. 10, 2007, which is incorporated by reference.

BACKGROUND OF THE INVENTION

1. Field of the Invention

The present invention relates to an engine unit for a vehicle that has a V-type engine and a throttle body assembly.

2. Description of Related Art

Various types of throttle body assemblies used for V-type engines are known. For example, FIG. 13 depicts a throttle body assembly 100 of a V-type engine disclosed in JP-A-2002-256900. As shown in FIG. 13, throttle body assembly 100 is provided with a motor 102 for driving a throttle valve 101. Motor 102 is disposed in an area enclosed by a total of four throttle bodies 103 and 104 in a plan view. Motor 102 is housed in an aluminum die cast housing 105. Housing 105 is attached and fixed to throttle bodies 103 and 104 in a suspended manner by a stay (not shown) that is suspended over throttle bodies 103 and 104.

As is disclosed in JP-A-2002-256900, housing 105 of motor 102 is attached and fixed to throttle bodies 103 and 104 by the stay in a suspended manner. Therefore, the strength of attachment of motor 102 can be ensured and the strength of the connection of throttle bodies 103 and 104 can be increased.

However, throttle body assembly 100 is disposed in the vicinity of an engine, which is a source of strong vibrations. Therefore, motor 102 cannot be fixed securely enough only by fixing motor 102 by the stay that bridges between throttle bodies 103 and 104. Accordingly, there is a problem that vibration occurring in motor 102 cannot be reduced enough.

Furthermore, when vibration occurs in motor 102, a load is applied to a deceleration gear mechanism that connects motor 102 and a valve shaft 107. Due to this, there is also a problem that the durability of throttle body assembly 100 is reduced.

SUMMARY OF THE INVENTION

The invention addresses the aforementioned problems and provides an engine unit in which an actuator for driving throttle valves is fixed securely and vibration occurring in the actuator is reduced.

An engine unit of the invention is provided with a V-type engine and a throttle body assembly. The V-type engine is provided with a front cylinder, a rear cylinder, a front intake port and a rear intake port. The front intake port is connected to the front cylinder. The rear intake port is connected to the rear cylinder. The throttle body assembly is attached to the V-type engine. The throttle body assembly includes a front throttle body, a rear throttle body, an actuator, a transmission gear mechanism and a casing. The front throttle body is provided with a front cylinder that is connected to the front intake port. The front throttle body includes a front throttle valve that opens and closes the front cylinder. The rear throttle body is provided with a rear cylinder that is connected to the rear intake port. The rear throttle body includes a rear throttle valve that opens and closes the rear cylinder. The actuator is disposed between a center axis of the front cylinder and a center axis of the rear cylinder in a longitudinal direction. The actuator drives the front and rear throttle valves. The transmission gear mechanism transmits power from the actuator to the front and rear throttle valves. The casing houses the actuator and the transmission gear mechanism and includes a first casing portion and a second casing portion. The first casing portion is fixed to the front throttle body and the rear throttle body. The second casing portion faces the first casing portion in a widthwise direction and is fixed to at least one of the front throttle body and the rear throttle body.

A vehicle according to the invention includes the engine unit described above.

In the invention, the casing that houses the actuator is supported at three points or more by at least three throttle bodies. Accordingly, the actuator is fixed securely and vibration occurring in the actuator is reduced.

Other features and advantages of the invention will be apparent from the following detailed description, taken in conjunction with the accompanying drawings that illustrate, by way of example, various features of embodiments of the invention.

DETAILED DESCRIPTION OF THE INVENTION

Figure 1:
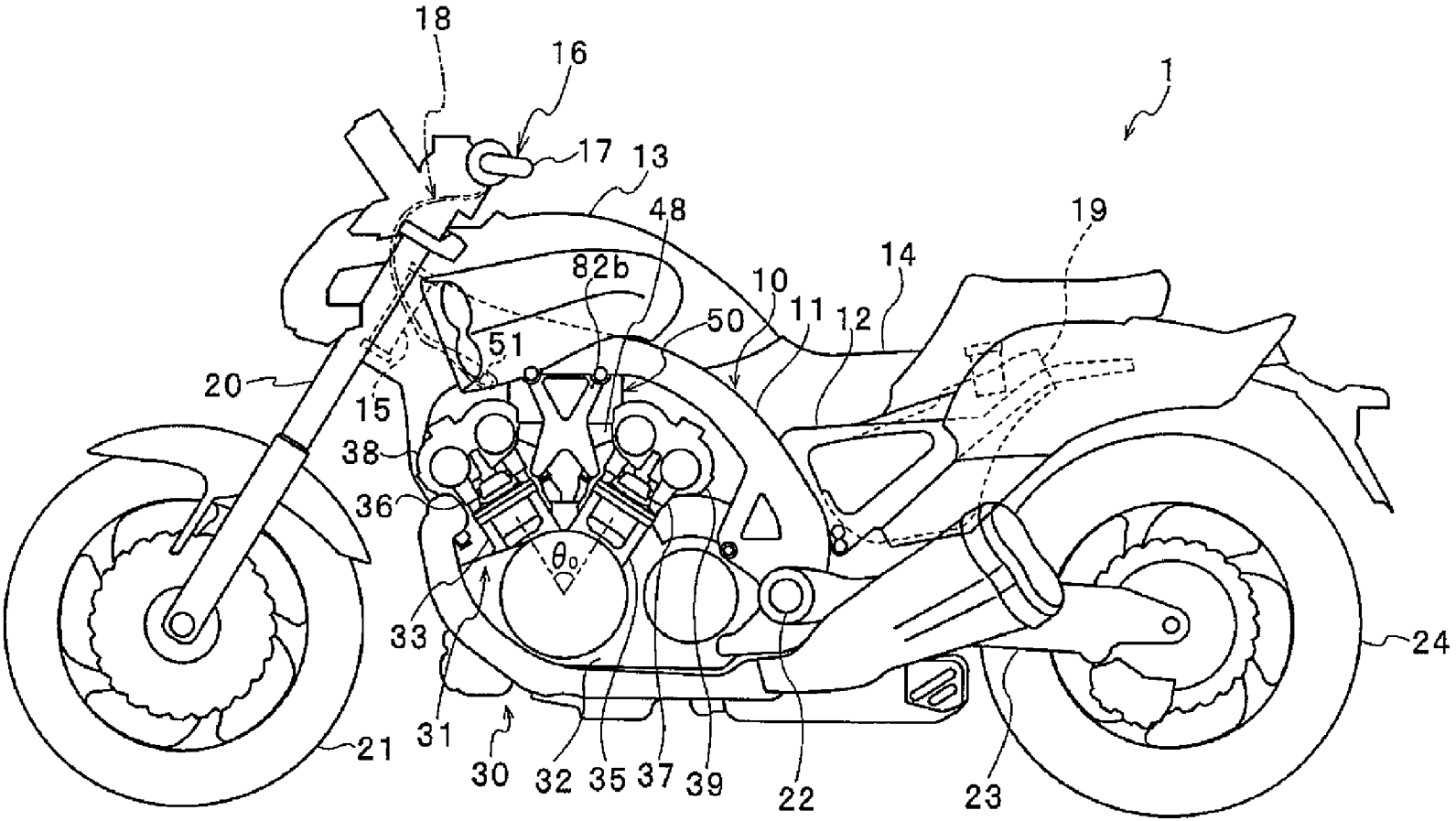
FIG. 1 is a left side view of a motorcycle according to the invention.

An embodiment of the invention is now described taking a motorcycle 1 shown in FIG. 1 as an example. However, the invention is not restricted to a motorcycle 1 and may be any vehicle that includes a V-type engine, including a four-wheeled vehicle or a straddle-type vehicle. A "straddle-type vehicle" refers to a vehicle on which a rider straddles a seat (saddle) and includes an all terrain vehicle (ATV) and the like in addition to a motorcycle. Furthermore, the motorcycle is not restricted to a so-called American-type motorcycle and includes a moped, a scooter, an off-road vehicle and the like. Moreover, a motorcycle also includes a vehicle with multiple wheels that rotate together with at least one of the front and rear wheels, and that is tilted to change a traveling direction.

The longitudinal and horizontal directions as used in the following description are from the perspective of a rider seated on a seat 14.

(Overall Structure of Motorcycle 1)

FIG. 1 is a schematic side view of motorcycle 1. As shown in FIG. 1, motorcycle 1 has a vehicle body frame 10, a vehicle body cover 13 and a seat 14. A part of vehicle body frame 10 is covered by vehicle body cover 13. Seat 14 is disposed on the top of vehicle body frame 10.

Vehicle body frame 10 has a main frame 11 and a rear frame 12. Main frame 11 has left and right frame portions 11*a* and 11*b* that extend to the rear from a head pipe 15 rotatably attached to main frame 11. A handle 16 is fixed to an upper end portion of head pipe 15 by a handle holder (not shown). Handle 16 is provided with a throttle grip 17 as a throttle operator. Throttle grip 17 is connected to an accelerator position sensor (APS) 51 by a throttle wire 18. Therefore, when throttle grip 17 is operated by a rider, throttle wire 18 is moved and the amount of operation of throttle grip 17 is detected by accelerator position sensor 51 as an accelerator opening angle.

A front fork 20 with forks to the left and right is fixed to head pipe 15. Front fork 20 extends obliquely downward to the front. A front wheel 21 is rotatably attached to a lower end portion of front fork 20.

A pivot shaft 22 is attached to a rear end portion of vehicle body frame 10. A rear arm 23 is attached to pivot shaft 22 in a swingable manner. A rear wheel 24 is rotatably attached to a rear end portion of rear arm 23. Rear wheel 24 is connected with an output shaft of an engine unit 30 later by a power transmission mechanism such as a drive shaft. Power from engine unit 30 is thereby transmitted to and rotates rear wheel 24.

Figure 2:
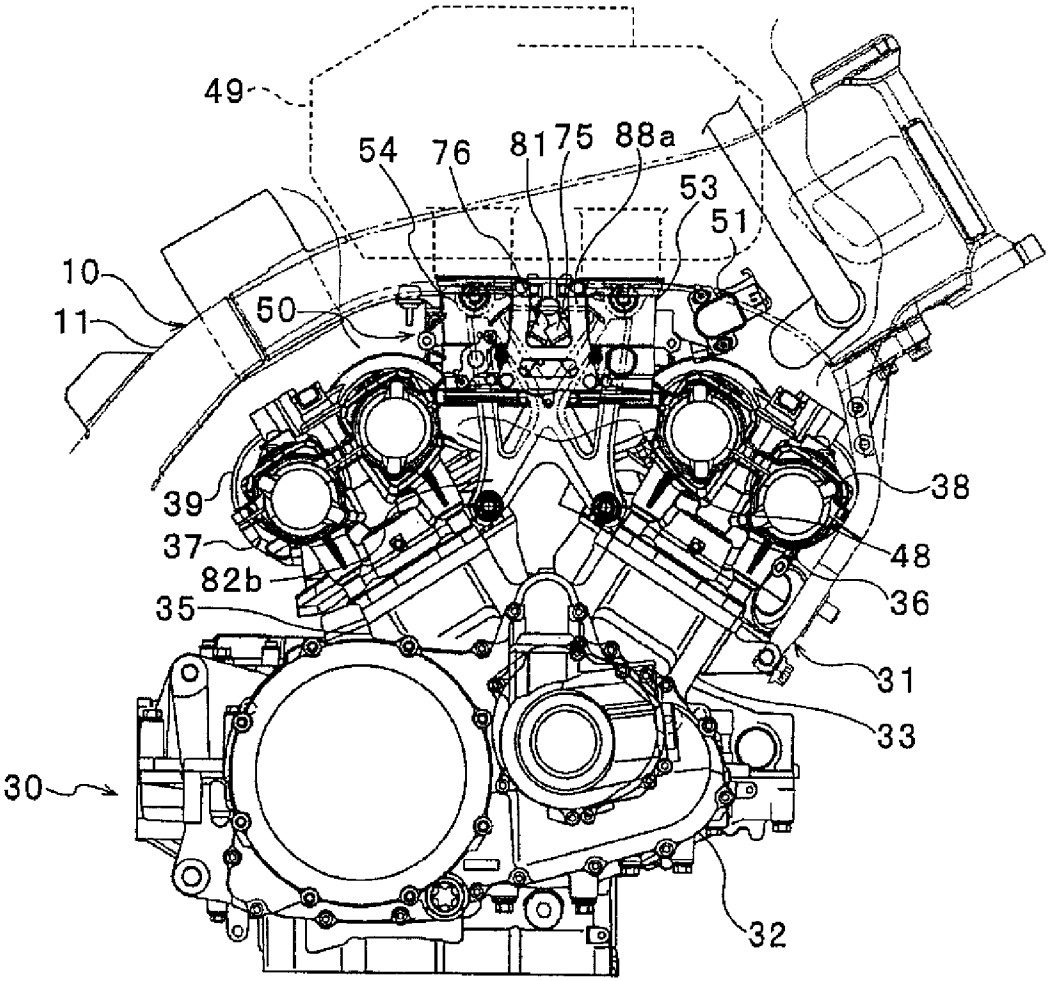
FIG. 2 is an enlarged right side view of an engine unit of the motorcycle.

As shown in FIGS. 1 and 2, engine unit 30 is suspended from main frame 11. Engine unit 30 is provided with a V-type engine 31, a throttle body assembly 50, a clutch, a transmission mechanism and the like. Throttle body assembly 50 is disposed on engine 31 between left and right frame portions 11*a* and 11*b* in a plan view.

Figure 3:
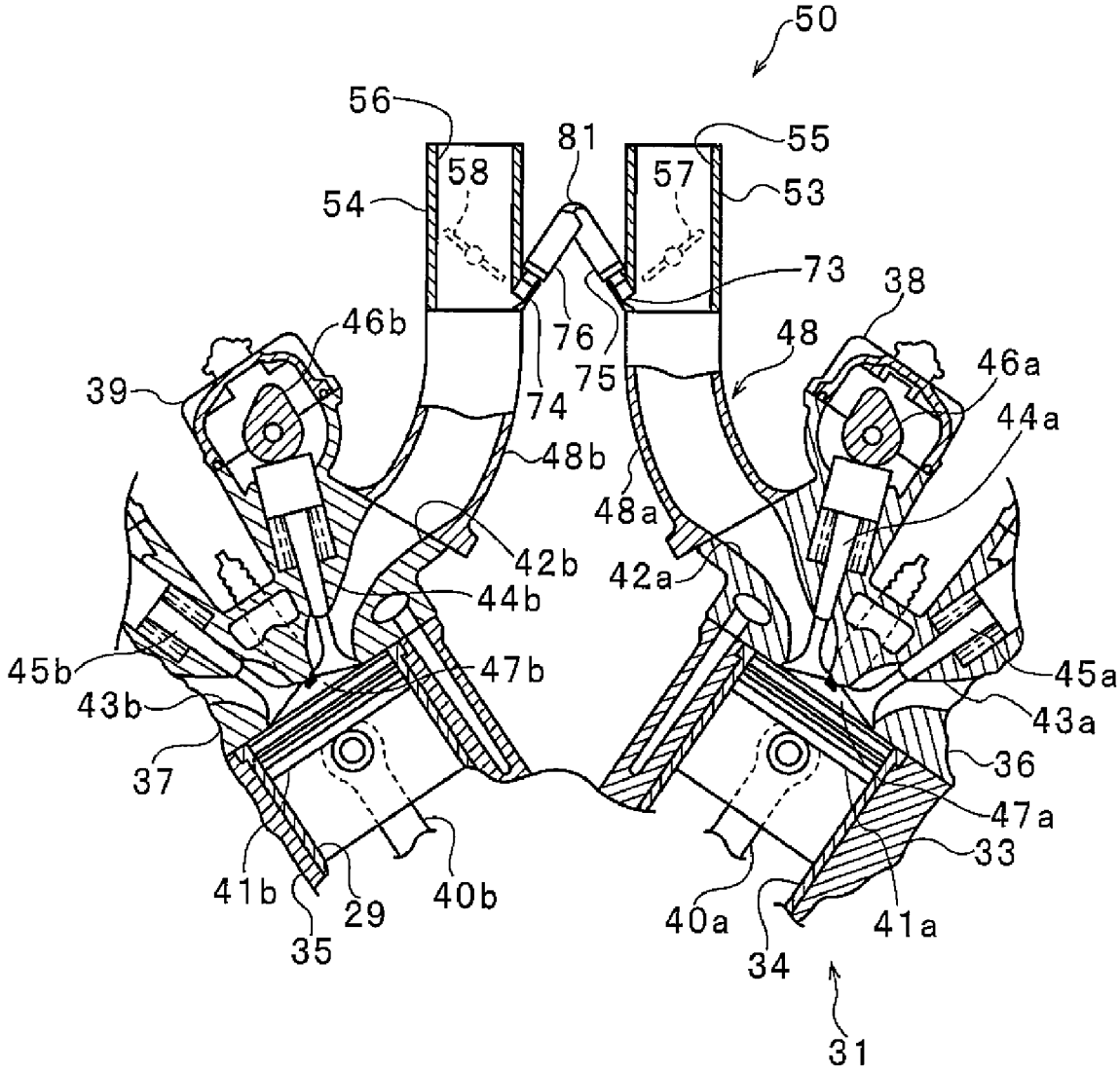
FIG. 3 is a cross-sectional view of a portion of a throttle body assembly and an engine of the engine unit.

An insulator 48 is disposed between engine unit 30 and throttle body assembly 50. Insulator 48, engine 31, and throttle body assembly 50 are mutually fixed by cross members 82*a* and 82*b* arranged at both sides of the vehicle in a widthwise direction. As shown in FIG. 3, insulator 48 is provided with connecting channels 48*a* and 48*b* that connect intake ports 42*a* and 42*b* of engine 31 to respective cylinders 55 and 56 of throttle body assembly 50.

As shown in FIG. 2, an air cleaner 49 which serves as an intake system part is arranged on and supplies outside air to throttle body assembly 50. Alternatively, an air chamber may be arranged as the intake system part in place of air cleaner 49.

As shown in FIG. 1, a fuel tank 19 is disposed at the rear of engine 31. Fuel tank 19 is connected with a fuel nipple 82 of throttle body assembly 50 shown in FIG. 4 by a fuel supply hose (not shown). Therefore, fuel stored in fuel tank 19 is supplied to throttle body assembly 50 through the fuel supply hose. Air and fuel supplied to throttle body assembly 50 are mixed in the throttle body assembly 50, thereby creating an air-fuel mixture that is supplied to engine 31.

Figure 4:
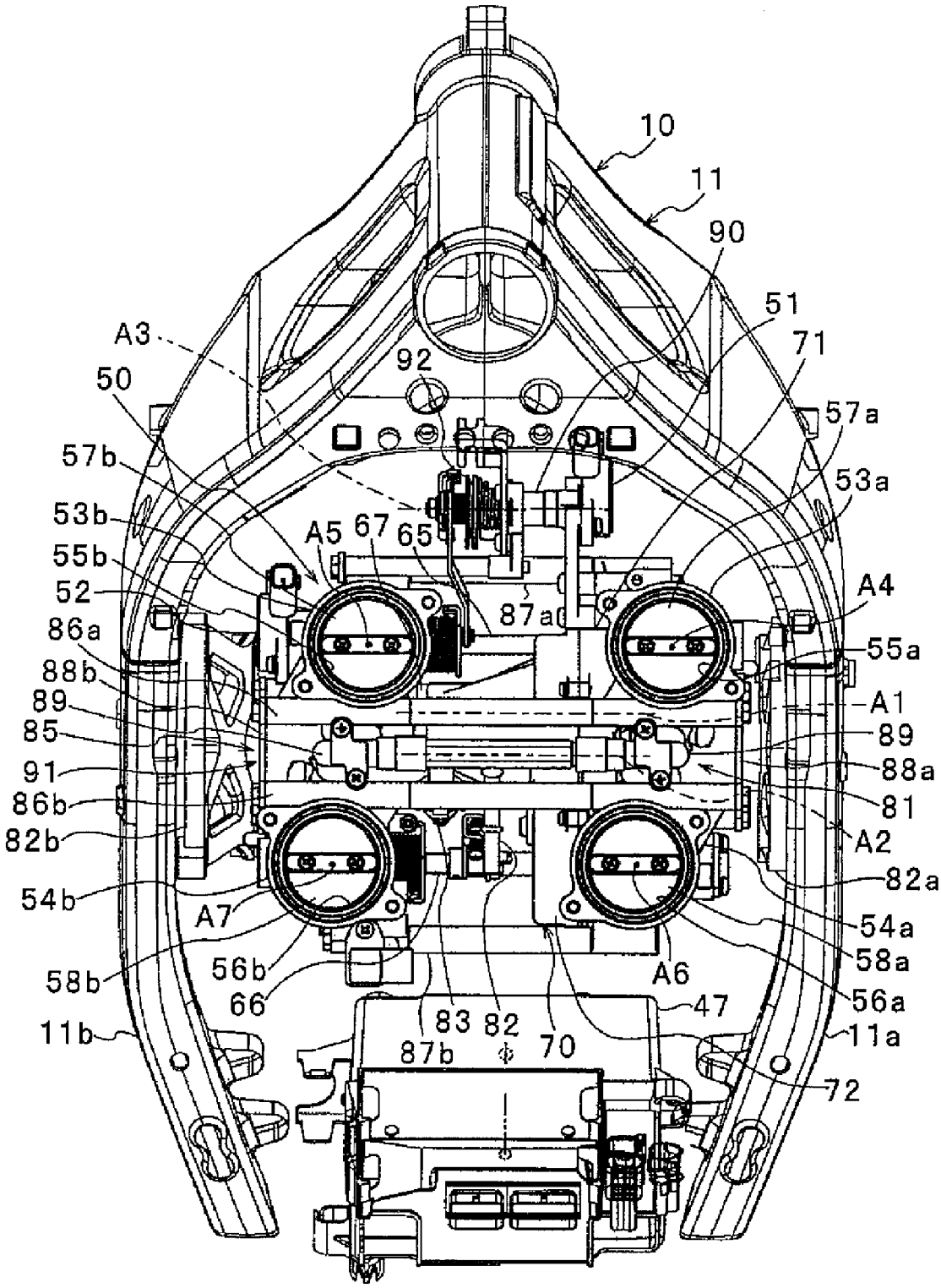
FIG. 4 is a plan view of the throttle body assembly.

As shown in FIG. 4, in a space enclosed by main frame 11 in a plan view, a battery 47 that supplies power to engine unit 30 and to throttle body assembly 50 is installed at the immediate rear of throttle body assembly 50.

(Engine 31)

An embodiment of engine 31 is described mainly with reference to FIGS. 1-3. In the embodiment, engine 31 is a water-cooled 4-stroke V-type 4-cylinder engine. However, engine 31 is not particularly restricted as long as it is a V-type engine and may be, for example, an air-cooled engine or a 2-stroke engine. Furthermore, engine 31 may be a V-type engine with three cylinders or less or five cylinders or more.

A "V-type engine" as used herein refers to an engine having a front cylinder and a rear cylinder that are arranged in such a manner as to form a V-bank. That is, the front and rear cylinders are arranged such that center axes of the front and rear cylinders diagonally intersect with each other with a shaft center of a crankshaft being the center of the intersection.

As shown in FIG. 2, engine 31 has a crankcase 32 that houses a crankshaft. Crankcase 32 is attached with a front cylinder body 33 and a rear cylinder body 35. Front cylinder body 33 and rear cylinder body 35 are arranged in a V-shape having the crankshaft as a center thereof in a side view. A front cylinder head 36 is provided on front cylinder body 33, and a front head cover 38 is provided on the top of front cylinder head 36. Similarly, a rear cylinder head 37 is provided on the top of rear cylinder body 35, and a rear head cover 39 is provided on top of rear cylinder head 37.

As shown in FIG. 3, a front cylinder 34 formed in a substantially cylindrical shape is provided in front cylinder body 33, and a rear cylinder 29 formed in a substantially cylindrical shape is provided in rear cylinder body 35. Front cylinder 34 and rear cylinder 29 are arranged in such a manner as to form a V-bank. More specifically, front cylinder 34 is disposed to extend obliquely upward to the front, while rear cylinder 29 is disposed to extend obliquely upward to the rear. The degree of an angle $\theta_0$ formed by a center axis of front cylinder 34 and a center axis of rear cylinder 29 (FIG. 1) is set such that front cylinder 34 and rear cylinder 29 do not positionally interfere with each other in consideration of engine noise caused by engine 31, characteristics to be obtained by engine 31, and the like. The angle $\theta_0$ is normally set in a range of 10-170 degrees, preferably in a range of 30-150 degrees, and more preferably in a range of 45-100 degrees.

As shown in FIG. 3, front cylinder 34 and rear cylinder 29 respectively house connecting rods 40*a* and 40*b* that are connected to respective crankshafts. Pistons 41*a* and 41*b* are attached to the tip end portions of connecting rods 40*a* and 40*b*. Pistons 41*a* and 41*b*, cylinders 34 and 29, and cylinder heads 36 and 37 define and form combustion chambers 47*a* and 47*b*.

Front cylinder head 36 and rear cylinder head 37 are provided with intake ports 42*a* and 42*b* and exhaust ports 43*a* and 43*b*, respectively. Intake ports 42*a* and 42*b* are provided with intake valves 44*a* and 44*b* that open and close intake ports 42*a* and 42*b*. Intake valves 44*a* and 44*b* are driven by intake cams 46*a* and 46*b* disposed on the top face of intake valves 44*a* and 44*b*. Exhaust ports 43*a* and 43*b* are provided with exhaust valves 45*a* and 45*b* that open and close exhaust port 43. Exhaust valves 45*a* and 45*b* are driven by exhaust cams.

(Throttle Body Assembly 50)

—Front Throttle Body 53 and Rear Throttle Body 54—

Throttle body assembly 50 is now described in detail referring mainly to FIG. 4 to FIG. 9. Throttle body assembly 50 includes a first front throttle body 53*a* and a second front throttle body 53*b*. In the following description, front throttle bodies 53*a* and 53*b* may be collectively called front throttle bodies 53.

Front throttle bodies 53*a* and 53*b* are arranged in the vehicle width direction. First front throttle body 53*a* is provided with a first front cylinder 55*a* formed in a substantially cylindrical shape, and second throttle body 53*b* is provided with a second front cylinder 55*b* formed in a substantially cylindrical shape. Front cylinders 55*a* and 55*b* extend in a vertical direction. In the following description, front cylinders 55*a* and 55*b* may be collectively called front cylinders 55.

Front throttle bodies 53*a* and 53*b* have front throttle valves 57*a* and 57*b*, respectively. In the following description, front throttle valves 57*a* and 57*b* may be collectively called front throttle valves 57. Front throttle valve 57*a* is connected with front throttle valve 57*b* by a valve shaft 65. When valve shaft 65 is rotated by a motor 60, front throttle valves 57*a* and 57*b* move simultaneously to open and close front cylinders 55*a* and 55*b*.

A first rear throttle body 54*a* and a second rear throttle body 54*b* are arranged at the rear of front throttle bodies 53*a* and 53*b*. In the following description, rear throttle bodies 54*a* and 54*b* may be collectively called rear throttle bodies 54.

Rear throttle bodies 54*a* and 54*b* are arranged in the vehicle width direction. First rear throttle body 54*a* is disposed approximately to the rear of first front throttle body 53*a*, and second rear throttle body 54*b* is disposed approximately to the rear of second front throttle body 53*b*. However, due to the arrangement of connecting rods 40*a* and 40*b*, front throttle bodies 53*a* and 53*b* are arranged slightly offset with respect to rear throttle bodies 54*a* and 54*b* in the vehicle width direction.

In the embodiment, upper ends of first front throttle body 53*a*, second front throttle body 53*b*, first rear throttle body 54*a* and second rear throttle body 54*b* are located at the same height.

First rear throttle body 54*a* is provided with a first rear cylinder 56*a* formed in a substantially cylindrical shape, and second rear throttle body 54*b* is provided with a second rear cylinder 56*b* formed in a substantially cylindrical shape. In the following description, rear cylinders 56*a* and 56*b* may be collectively called rear cylinders 56.

Rear throttle bodies 54*a* and 54*b* have rear throttle valves 58*a* and 58*b*, respectively. Hereafter, rear throttle valves 58*a* and 58*b* may be collectively called rear throttle valves 58. Rear throttle valve 58*a* is connected with rear throttle valve 58*b* by a valve shaft 66. Therefore, when valve shaft 66 is rotated by motor 60, rear throttle valves 58*a* and 58*b* move simultaneously to open and close rear cylinders 56*a* and 56*b*.

As shown in FIG. 2, the upper end portions of front cylinders 55 and rear cylinders 56 are connected to air cleaner 49. The lower ends of front cylinders 55 and rear cylinders 56 are connected to intake ports 42*a* and 42*b*, as shown in FIG. 3. By this structure, air taken from air cleaner 49 is supplied to engine 31 via throttle body assembly 50.

—Injectors 75 and 76 and Fuel Supply Pipe 81—

Figure 8:
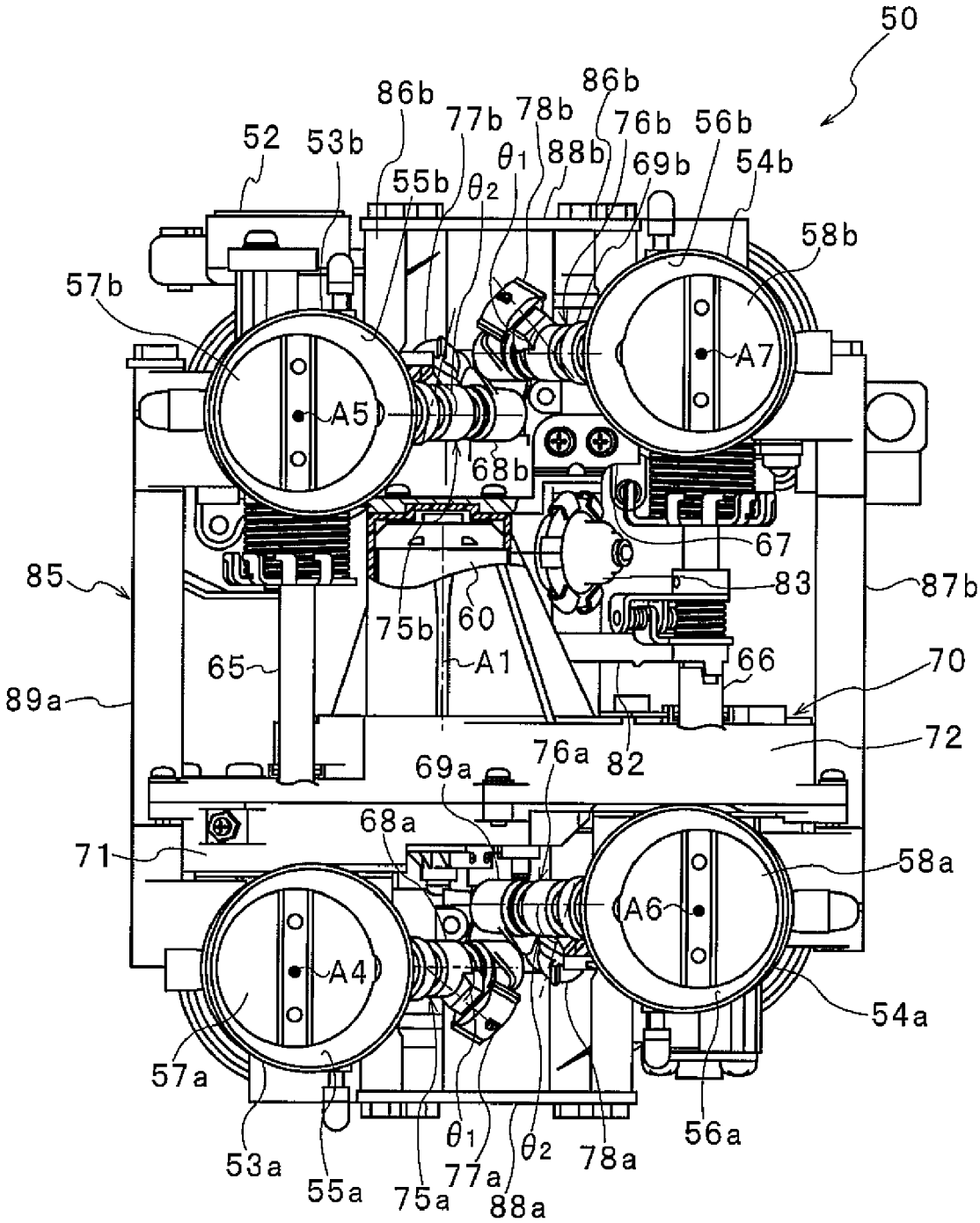
FIG. 8 is a rear view of the throttle body assembly.

As mainly shown in FIG. 8, front throttle bodies 53*a* and 53*b* are provided with front injectors 75*a* and 75*b*, respectively. Meanwhile, rear throttle bodies 54*a* and 54*b* are provided with rear injectors 76*a* and 76*b*, respectively. Hereafter, front injectors 75*a* and 75*b* may be collectively called front injectors 75, and rear injectors 76*a* and 76*b* may be collectively called rear injectors 76.

As shown in FIGS. 2 and 3, respective upper end portions of front injectors 75 and rear injectors 76 are connected to a fuel supply pipe 81. As shown in FIG. 4, fuel supply pipe 81 extends between front cylinders 55 and rear cylinders 56 in the vehicle width direction. More specifically, fuel supply pipe 81 is arranged such that a center axis A2 thereof is located at the center of center axes A4 and A5 of front cylinders 55 and center axes A6 and A7 of rear cylinders 56 in the longitudinal direction. Furthermore, in relation to the vertical direction, fuel supply pipe 81 is disposed at a position that is lower than the upper ends of throttle bodies 53 and 54 and higher than the lower ends of throttle bodies 53 and 54. Note that, when the upper ends of throttle bodies 53 and 54 are different in height, which is not the case in this embodiment, fuel supply pipe 81 is preferably be disposed at a position lower than the upper ends of front throttle bodies 53 or the upper ends of rear throttle bodies 54, whichever is higher.

As shown in FIG. 4, fuel supply pipe 81 is connected with a fuel nipple 82 that extends to the rear from fuel supply pipe 81 between rear cylinders 56*a* and 56*b*. Fuel nipple 82 is connected to fuel tank 19 shown in FIG. 1 by a fuel supply pipe (not shown). Therefore, fuel stored in fuel tank 19 is supplied to front injectors 75 and rear injectors 76 via the fuel pipe, fuel nipple 82 and fuel supply pipe 81.

As shown in FIG. 4 and FIG. 8, a pulsation damper 83 is attached to fuel supply pipe 81. Pulsation damper 83 is located at the rear of and slightly obliquely downward from fuel supply pipe 81. Pulsation damper 83 suppresses pulsation of fuel supplied to front injectors 75 and rear injectors 76.

A nozzle 73 provided at the tip ends of front injectors 75 as shown in FIG. 3 is adjusted such that fuel injected from front injectors 75 is injected centering on the center axis direction of front cylinders 55. Similarly, a nozzle 74 provided at the tip ends of rear injectors 76 is adjusted such that fuel is injected centering on the center axis direction of rear cylinders 56.

Figure 6:
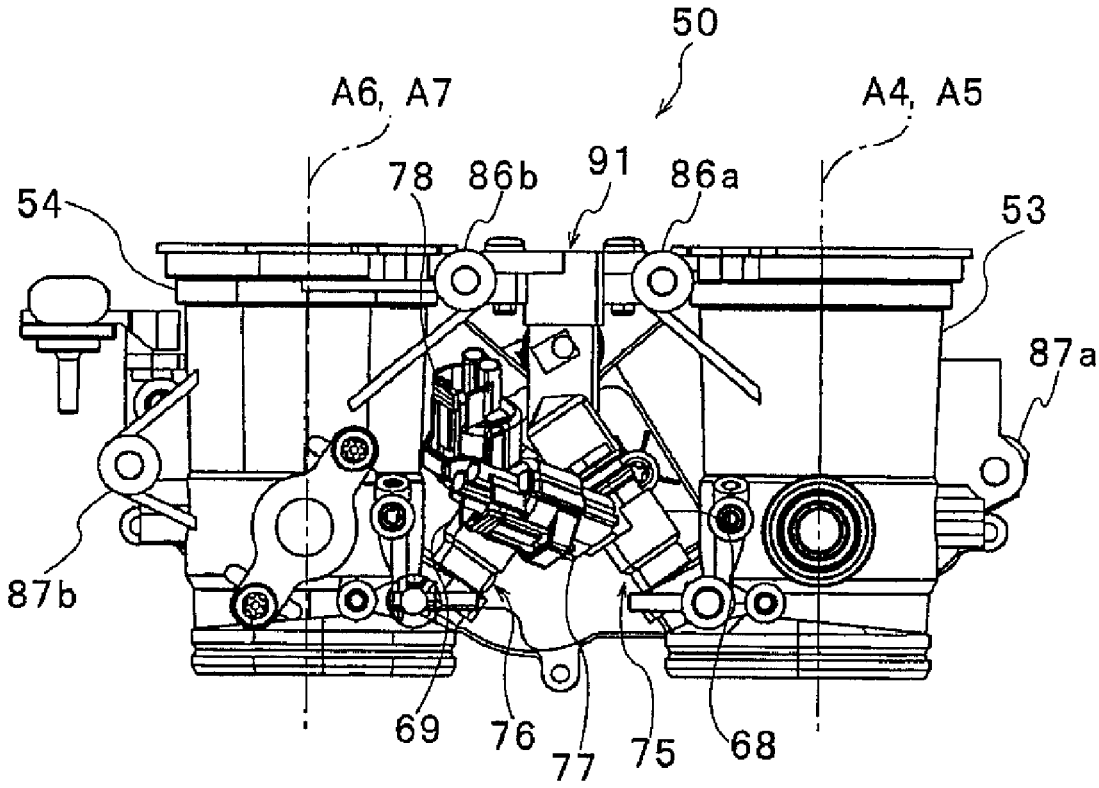
FIG. 6 is a right side view of the throttle body assembly.
Figure 7:
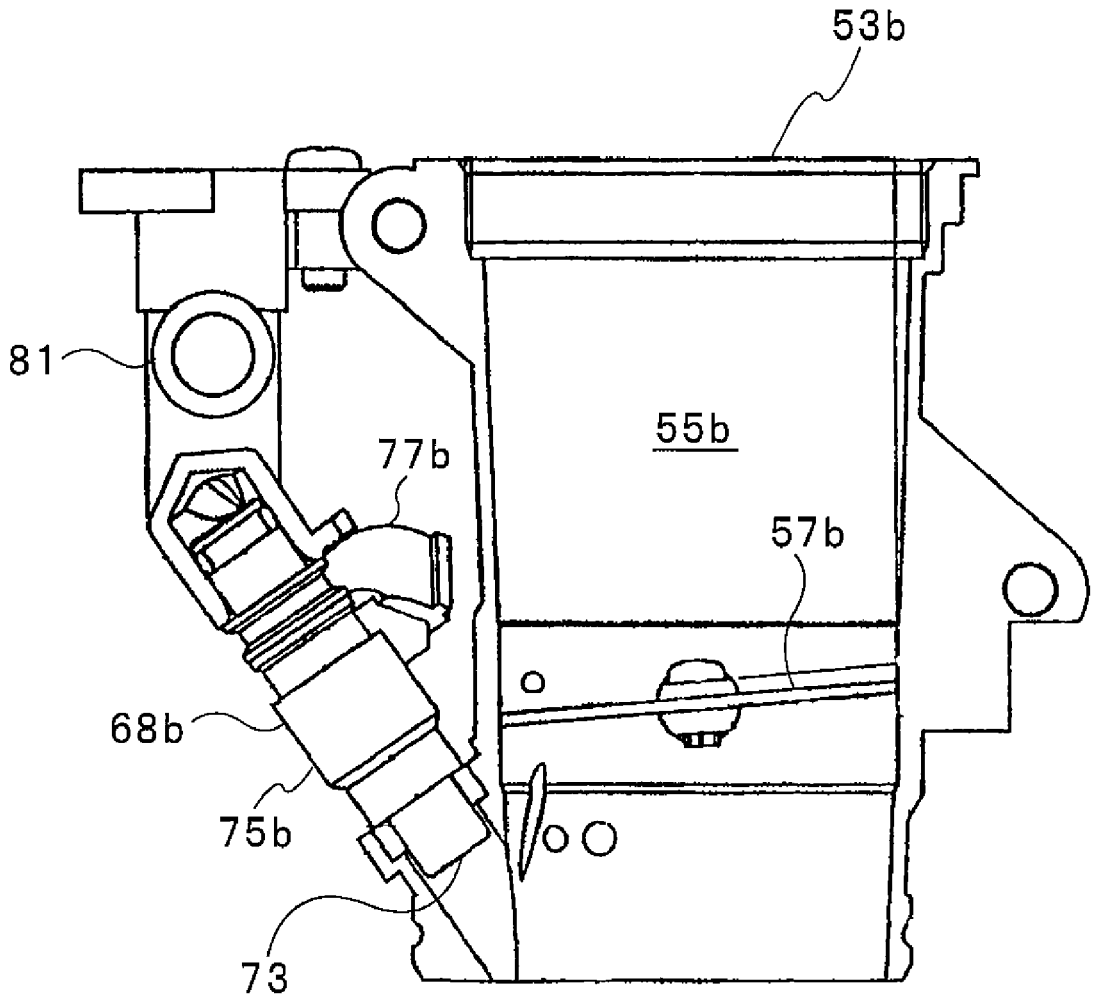
FIG. 7 is a cross-sectional view of a second front throttle body.

As shown in FIG. 6 and FIG. 8, front injectors 75*a* and 75*b* include injector main bodies 68*a* and 68*b* and first front connectors 77*a* and 77*b*. Rear injectors 76*a* and 76*b* include injector main bodies 69*a* and 69*b* and first rear connectors 78*a* and 78*b*. Hereafter, injector main bodies 68*a* and 68*b* may be collectively called injector main bodies 68, first front connectors 77*a* and 77*b* may be collectively called front connectors 77, injector main bodies 69*a* and 69*b* may be collectively called injector main bodies 69, and first rear connectors 78*a* and 78*b* may be collectively called rear connectors 78.

Figure 10:
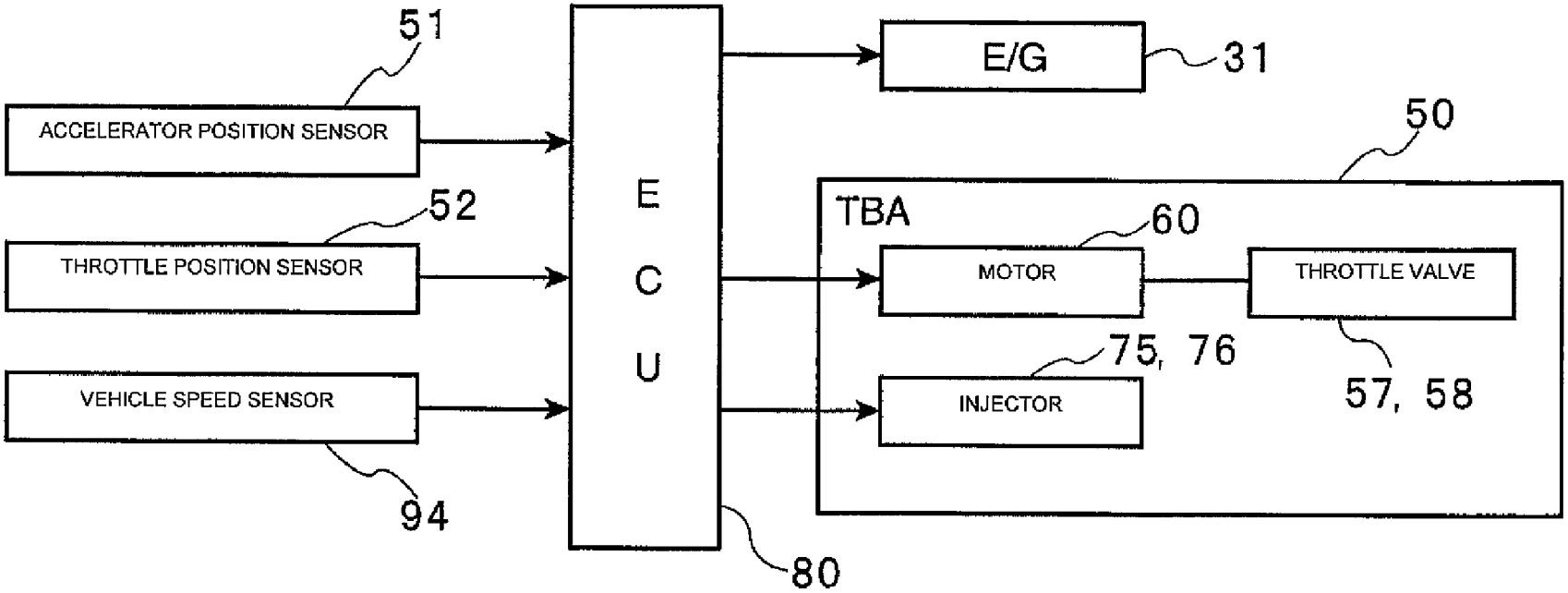
FIG. 10 is a block diagram of a control block of the motorcycle.

Connectors 77 and 78 are connected to an electronic control unit (ECU) 80 shown in FIG. 10. A control signal is sent from ECU 80 to front and rear injectors 75 and 76 via connectors 77 and 78, thereby controlling fuel injection from injectors 75 and 76. Note that, although FIG. 6 is a right side view of throttle body assembly 50, a right fixing plate 88*a* shown in FIG. 4 is omitted from FIG. 6 for convenience in illustrating connectors 77 and 78.

As shown in FIG. 8, injector main bodies 68 and 69 extend in the longitudinal direction in a plan view. On the other hand, connectors 77 and 78 extend obliquely in relation to the longitudinal direction in the plan view. To be specific, front connectors 77*a* and 77*b* extend obliquely to the rear in mutually opposite directions in the vehicle width direction. More specifically, front connectors 77*a* and 77*b* extend obliquely to the rear and outward in the vehicle width direction. Rear connectors 78*a* and 78*b* extend obliquely to the rear in mutually opposite directions in the vehicle width direction. To be specific, rear connectors 78*a* and 78*b* extend obliquely to the rear and outward in the vehicle width direction.

An angle formed by the center axis of injector main body 68*a* located on the outer side of the vehicle in the vehicle width direction and an extending direction of first front connector 77*a* in the plan view, and an angle formed by the centerline of injector main body 69*b* and an extending direction of second rear connector 78*b* in the plan view are both equally set to be $\theta_1$. Meanwhile, an angle formed by the center axis of injector main body 68*b* located on the inner side of the vehicle in the vehicle width direction and an extending direction of second front connector 77*b* in the plan view, and an angle formed by the center axis of injector main body 69*a* and an extending direction of first rear connector 78*a* in the plan view are both equally set to be $\theta_2$. The same $\theta_1$ and $\theta_2$ are set within a range that does not cause positional interference between front connectors 77 and rear connectors 78. A preferable range of $\theta_1$ and $\theta_2$ is between 5 and 180 degrees.

—Motor 60—

Figure 9:
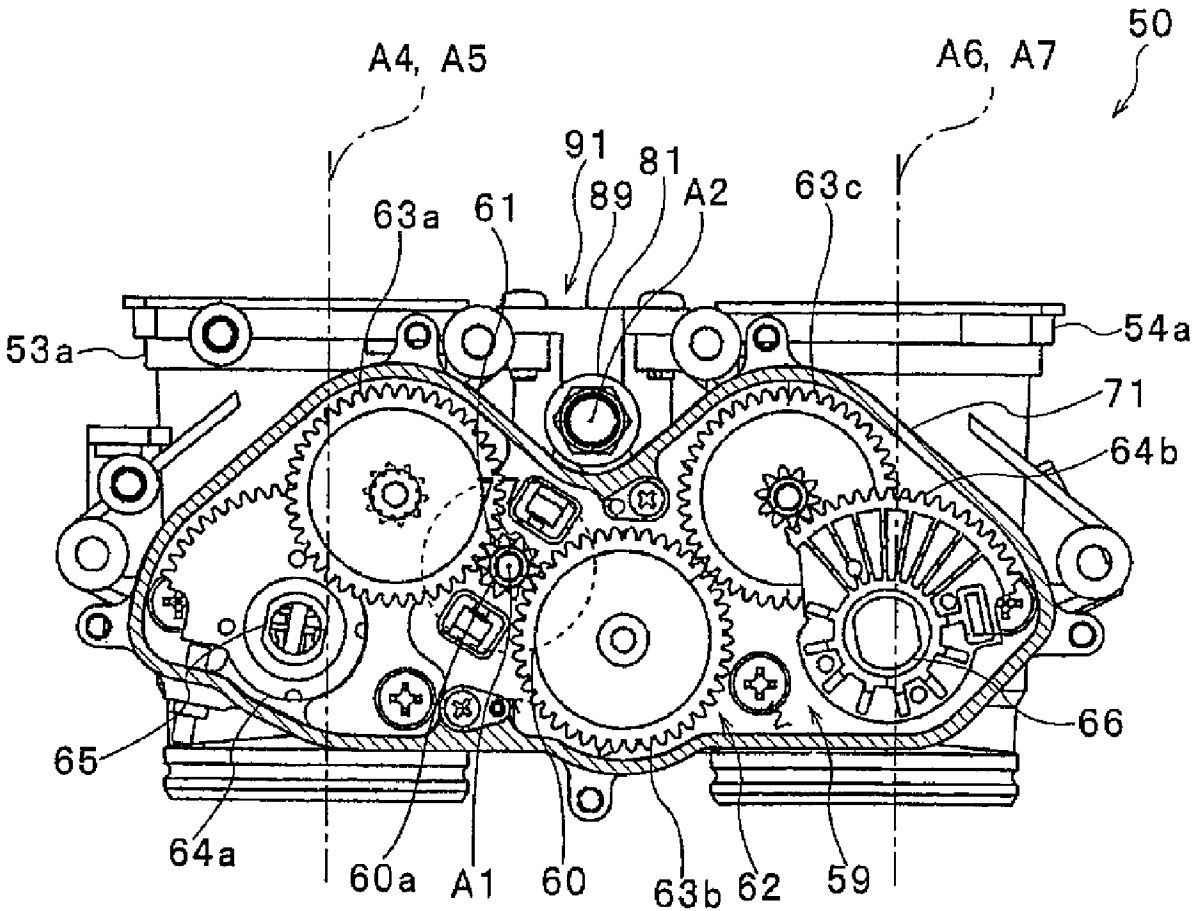
FIG. 9 is a cross-sectional view of a portion of the throttle body assembly illustrating a deceleration gear mechanism.

Throttle body assembly 50 has a motor 60. As shown in FIG. 9, motor 60 has a rotational shaft 60*a* as a first rotational shaft. A shaft center A1 of rotational shaft 60*a* extends in the vehicle width direction.

Rotational shaft 60*a* is provided with a motor pinion gear 61. Motor pinion gear 61 is engaged with a transmission gear mechanism 62 that includes three idle gears 63*a*, 63*b* and 63*c* and two counter gears 64*a* and 64*b*. Counter gear 64*a* is fixed to valve shaft 65, and counter gear 64*b* is fixed to valve shaft 66. Motor pinion gear 61 is engaged with counter gear 64*a* via one idle gear 63*a*. On the other hand, since motor pinion gear 61 and counter gear 64*b* are located relatively apart from each other, motor pinion gear 61 is engaged with counter gear 64*b* via two idle gears 63*b* and 63*c*. By this structure, when motor 60 is driven and motor pinion gear 61 rotates, counter gears 64*a* and 64*b* are rotated and valve shafts 65 and 66 are rotated in the same direction. As a result, front throttle valves 57*a* and 57*b* and rear throttle valves 58*a* and 58*b* shown in FIG. 4 are rotated, and thus front cylinders 55 and cylinders 56 are opened and closed in synchronization. In this description, motor 60 and transmission gear mechanism 62 are collectively called a throttle valve drive mechanism 59.

As shown in FIG. 8, in a plan view, motor 60 as an actuator is disposed in an area enclosed by center axis A4 of first front cylinder 55*a*, center axis A5 of second front cylinder 55*b*, center axis A6 of first rear cylinder 56*a*, and center axis A7 of second rear cylinder 56*b*. As FIG. 9 illustrates, in relation to the vertical direction, motor 60 is disposed at a position that is lower than the upper ends and higher than the lower ends of front throttle bodies 53 and rear throttle bodies 54. That is, motor 60 is disposed in a space enclosed by the four throttle bodies, namely, front throttle bodies 53*a* and 53*b* and rear throttle bodies 54*a* and 54*b*.

As shown in FIGS. 9 and 4, motor 60 is offset with respect to fuel supply pipe 81 in the longitudinal direction. Specifically, shaft center A1 of rotational shaft 60*a* as first rotational shaft of motor 60 and center axis A2 of fuel supply pipe 81 are located at different positions in the longitudinal direction. More specifically, shaft center A1 is located in front of center axis A2 of fuel supply pipe 81. That is, as FIG. 9 illustrates, motor 60 is disposed such that shaft center A1 is located, in the longitudinal direction, between center axis A2 of fuel supply pipe 81 and center axes A4 and A5 of front cylinders 55.

—Casing 70—

As shown in FIGS. 4 and 8, motor 60 and transmission gear mechanism 62 are housed in a casing 70. As FIG. 8 illustrates, valve shafts 65 and 66 connected to transmission gear mechanism 62 pass through casing 70.

Casing 70 has a first casing portion 71 and a second casing portion 72 that face each other in the vehicle width direction. First casing portion 71 and second casing portion 72 are fixed to each other by a bolt, rivet, or the like. First casing portion 71 is disposed closer to transmission gear mechanism 62 and is made of a metal such as iron or an alloy such as aluminum and stainless steel. In the embodiment, first casing portion 71 is made of die cast aluminum.

First casing portion 71 is fixed to first front throttle body 53*a* and first rear throttle body 54*a*. Specifically, a portion of casing 70 that houses transmission gear mechanism 62 and is penetrated by valve shafts 65 and 66 is directly fixed to first front throttle body 53*a* and first rear throttle body 54*a*.

Second casing portion 72 is located closer to motor 60 and is made of a resin such as, for instance, polybutylene terephthalate (PBT) or the like. The resin that forms second casing portion 72 may include, for example, a glass fiber. Second casing portion 72 may also be made of metal like first casing portion 71.

As shown in FIG. 8, second casing portion 72 is fixed to second rear throttle body 54*b* via a metal stay 67. To be more specific, stay 67 is fastened by a bolt to a top part of a portion of second casing portion 72 that houses motor 60. Stay 67 is also fastened by a bolt to second rear throttle body 54*b*.

—Connecting Member 85—

As shown in FIG. 4, front throttle bodies 53*a* and 53*b* and rear throttle bodies 54*a* and 54*b* are fixed to each other by a connecting member 85. Connecting member 85 includes two inner connecting pipes 86*a* and 86*b*, two outer connecting pipes 87*a* and 87*b*, right fixing plate 88*a*, and a left fixing plate 88*b*.

Inner connecting pipes 86*a* and 86*b* and outer connecting pipes 87*a* and 87*b* extend in the vehicle width direction. As is illustrated by FIG. 6, inner connecting pipes 86*a* and 86*b* are disposed in different positions to outer connecting pipes 87*a* and 87*b* in the vertical direction. Specifically, inner connecting pipes 86*a* and 86*b* are disposed approximately at the same position in the vertical direction as the upper end portions of throttle bodies 53 and 54. On the other hand, outer connecting pipes 87*a* and 87*b* are disposed approximately at the same position in the vertical direction as the center portions of throttle bodies 53 and 54.

As shown in FIGS. 4 and 6, inner connecting pipes 86*a* and 86*b* are disposed between center axes A4 and A5 of front cylinders 55 and center axes A6 and A7 of rear cylinders 56. Inner connecting pipe 86*a* is fixed to front throttle bodies 53*a* and 53*b* to the rear of center axes A4 and A5 of front cylinders 55. Meanwhile, inner connecting pipe 86*b* is fixed to rear throttle bodies 54*a* and 54*b* to the front of center axes A6 and A7 of rear cylinders 56. Inner connecting pipes 86*a* and 86*b* are mutually fixed at two points in the widthwise direction by two fixing members 89. In the following description, inner connecting pipes 86*a* and 86*b* as well as fixing members 89 are collectively called inner connecting member 91.

Outer connecting pipe 87*a* is fixed to front throttle bodies 53*a* and 53*b* to the front of center axes A4 and A5 of front cylinders 55. On the other hand, outer connecting pipe 87*b* is fixed to rear throttle bodies 54*a* and 54*b* to the rear of center axes A6 and A7 of rear cylinders 56.

As described above, front throttle bodies 53*a* and 53*b* are securely fixed to each other by being sandwiched by inner connecting pipe 86*a* and outer connecting pipe 87*a*. Furthermore, rear throttle bodies 54*a* and 54*b* are securely fixed to each other by being sandwiched by inner connecting pipe 86*b* and outer connecting pipe 87*b*.

Figure 5:
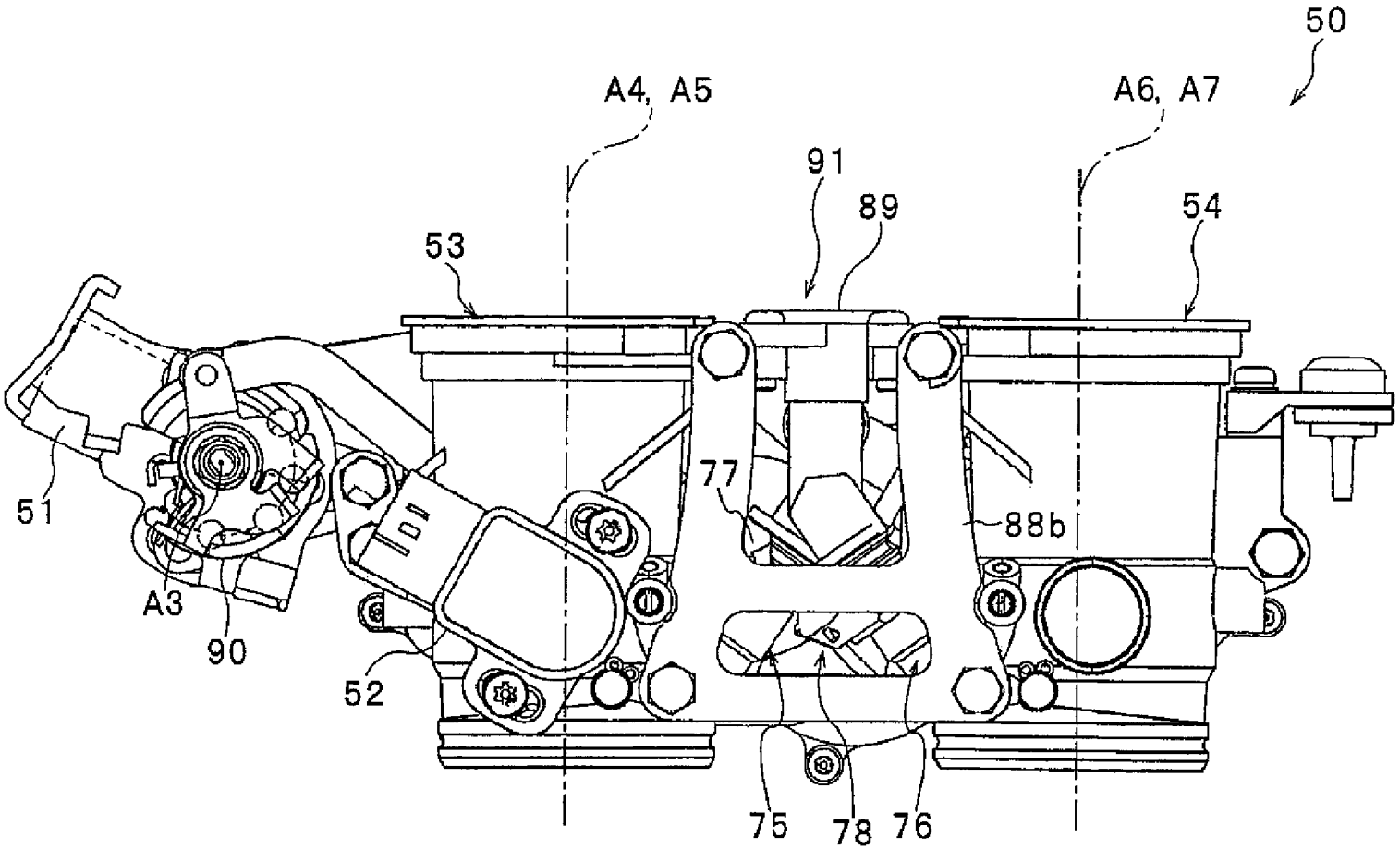
FIG. 5 is a left side view of the throttle body assembly.

In addition, as shown in FIGS. 4 and 5, front throttle bodies 53*a* and 53*b* and rear throttle bodies 54*a* and 54*b* are fixed to each other by right fixing plate 88*a* that serves as a right fixing member and left fixing plate 88*b* that serves as a left fixing member. More specifically, as shown in FIG. 5, left fixing plate 88*b* is fixed by four points, namely, the upper and lower portions of second front throttle body 53*b* and the upper and lower portions of second rear throttle body 54*b*. Right fixing plate 88*a* is fixed by four points, namely, the upper and lower portions of first front throttle body 53*a* and the upper and lower portions of first rear throttle body 54*a*.

As described above, front throttle bodies 53*a* and 53*b* and rear throttle bodies 54*a* and 54*b* are fixed to each other by right fixing plate 88*a*, left fixing plate 88*b*, and inner connecting member 91. In a plan view, as a connecting member for mutually fixing front throttle bodies 53*a* and 53*b* and rear throttle bodies 54*a* and 54*b*, inner connecting member 91 only is disposed in an area enclosed by center axes A4 and A5 and center axes A6 and A7. In the area enclosed by center axes A4 and A5 and center axes A6 and A7, no connecting members that mutually fix front throttle bodies 53*a* and 53*b* with rear throttle bodies 54*a* and 54*b* are disposed below fuel supply pipe 81.

—Accelerator Position Sensor 51 and Throttle Position Sensor 52—

As shown in FIG. 4, throttle body assembly 50 is provided with accelerator position sensor 51 and a throttle position sensor 52. Throttle position sensor 52 is disposed to the left of second front throttle body 53*b* and is connected to valve shaft 65. Throttle position sensor 52 detects a throttle opening angle by detecting rotation of valve shaft 65.

Accelerator position sensor 51 is connected to the right end portion of APS shaft 90 that serves as the second rotational shaft. As FIG. 5 illustrates, a shaft center A3 of APS shaft 90 is located at a position lower than the upper ends of throttle bodies 53 and 54. Note that, when the upper ends of throttle bodies 53 and 54 are different in height, which is not the case in this embodiment, APS shaft 90 is preferably disposed at a position lower than the upper ends of front throttle bodies 53 or than the upper ends of rear throttle bodies 54, whichever is higher.

As shown in FIGS. 4 and 5, in a plan view, motor 60 is disposed in the area enclosed by center axes A4 and A5 of front cylinders 55 and center axes A6 and A7 of rear cylinders 56. Meanwhile, APS shaft 90 is disposed outside the area. Specifically, in relation to the longitudinal direction, center axis A3 of APS shaft 90 is located to the front of center axes A4 and A5 of front cylinders 55. More specifically, as shown mainly in FIG. 2, APS shaft 90 is disposed between front head cover 38 and air cleaner 49 in the side view. In this manner, APS shaft 90 is offset with respect to motor 60 in the longitudinal direction.

As shown in FIG. 4, a pulley 92 is attached to APS shaft 90. Throttle wire 18 shown in FIG. 1 is wound around pulley 92. Therefore, when throttle grip 17 is operated, throttle wire 18 moves, thereby rotating APS shaft 90. Accelerator position sensor 51 detects an accelerator opening angle by detecting rotation of APS shaft 90.

(Control Block of Motorcycle 1)

A control block of motorcycle 1 as shown in FIG. 10 is now described in detail. Electronic control unit (ECU) 80 is provided as a controller and is connected to various types of sensors including accelerator position sensor 51, throttle position sensor 52, a vehicle speed sensor 94 and the like. Accelerator position sensor 51 outputs an accelerator opening angle to ECU 80. Throttle position sensor 52 outputs a throttle opening angle to ECU 80. Vehicle speed sensor 94 outputs a vehicle speed to ECU 80. ECU 80 is connected to and controls engine 31 based on the input accelerator opening angle, throttle opening angle, vehicle speed and the like.

In addition, ECU 80 is connected to throttle body assembly 50. Specifically, ECU 80 is connected to motor 60 and injectors 75 and 76. ECU 80 drives motor 60 based on the input accelerator opening angle, throttle opening angle, vehicle speed and the like. As motor 60 is driven, valve shaft 65 and valve shaft 66 rotate accordingly. As a consequence, throttle valves 57 and 58 move, thereby opening and closing front cylinders 55 and rear cylinders 56. As a result, air taken from air cleaner 49 is introduced into cylinders 55 and 56.

At the same time, ECU 80 controls the amount of fuel supplied from injectors 75 and 76 based on the input accelerator opening angle, throttle opening angle, vehicle speed and the like. Fuel injected from injectors 75 and 76 is mixed with air supplied from air cleaner 49 to create an air-fuel mixture that is supplied to intake ports 42*a* and 42*b* (FIG. 3).

(Operation and Effects)

Figure 13:
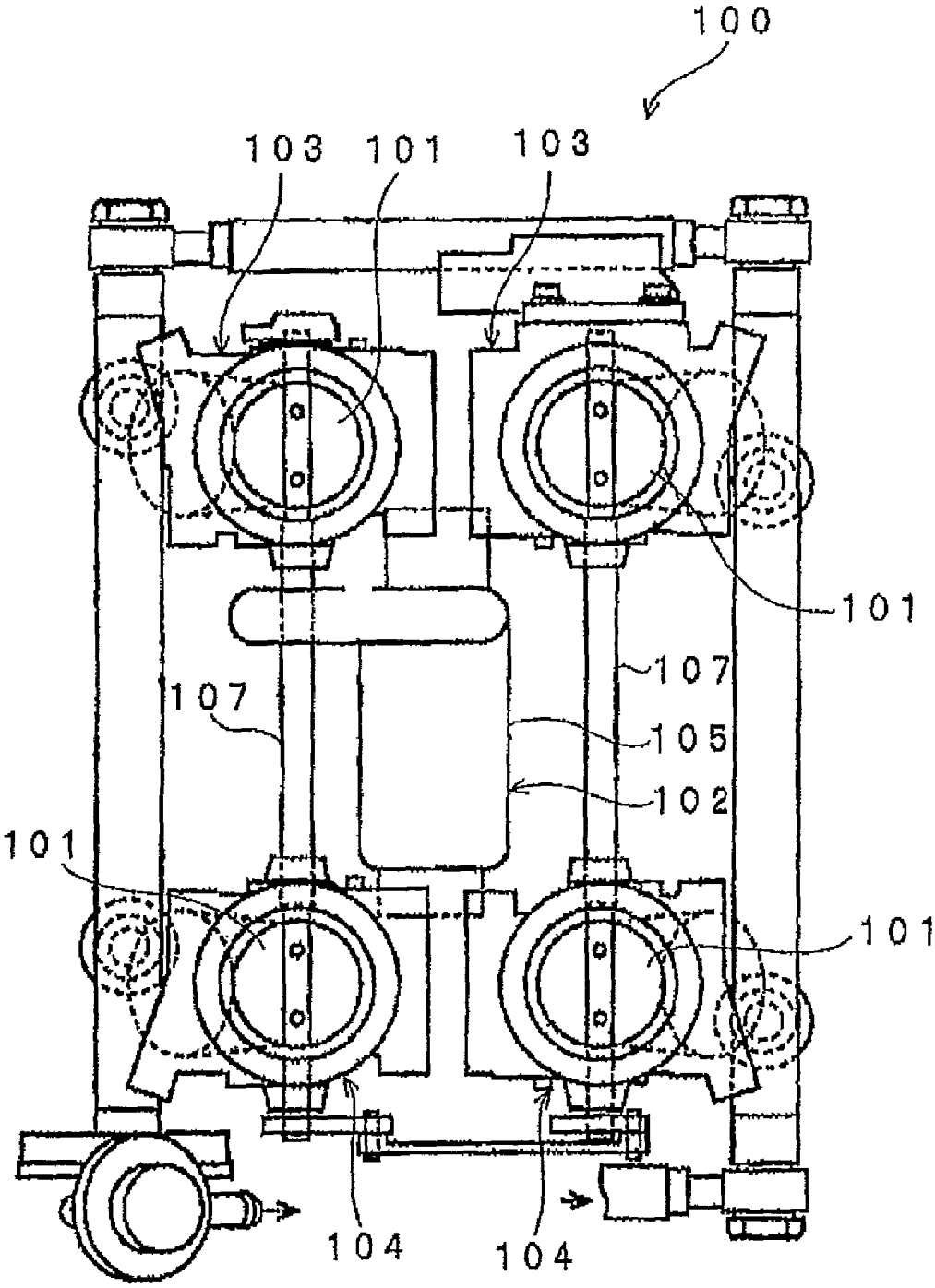
Fig. 13 PRIOR ART
FIG. 13 is a plan view of a throttle body assembly 100 of a V-type engine of the related art.

In the known throttle body assembly 100 illustrated in FIG. 13, housing 105 of motor 102 is fixed solely by a stay (not shown) that forms a bridge between throttle bodies 103 and 104. In other words, housing 105 of motor 102 is fixed at two points only. Therefore, motor 102 is not fixed securely enough. Accordingly, it is difficult to sufficiently suppress vibration occurring in motor 102. As a result, the transmission gear mechanism that transmits power between motor 102 and valve shaft 107 is subjected to load.

Furthermore, to avoid interference between motor 102 that vibrates or oscillates and other members arranged adjacent to motor 102, it is necessary to provide a relatively large clearance between motor 102 and the other members arranged adjacent to motor 102. Therefore, throttle body assembly 100 as well as the engine unit provided with throttle body assembly 100 tends to become large in size.

On the other hand, in the embodiment, first casing portion 71 is fixed to first front throttle body 53*a* and first rear throttle body 54*a*. In addition, second casing portion 72 is fixed to second rear throttle body 54*b*. Therefore, casing 70, which houses motor 60 that serves as the actuator, is fixed at three points. As a result, vibration occurring in motor 60 is effectively suppressed and a load applied to transmission gear mechanism 62 is reduced.

Moreover, since vibration occurring in motor 60 is suppressed, clearance between casing 70 that houses motor 60 and other members arranged adjacent to casing 70 is reduced. As a consequence, the size of throttle body assembly 50 as well as engine unit 30 can be reduced.

Size reduction of engine unit 30 is required for any type of vehicle. However, such a requirement more strictly applies to straddle-type vehicles, particularly motorcycles, as illustrated in the embodiment. This is because it is preferable to reduce the vehicle width as much as possible with straddle-type vehicles such as motorcycles. A reduction in the vehicle width is particularly required for a motorcycle which has engine unit 30 disposed between frame portions 11*a* and 11*b* in a plan view, as shown in FIG. 4. Therefore, the present invention, which allows size reduction of engine unit 30, is particularly effective for straddle-type vehicles and motorcycles, particularly the motorcycle in which engine unit 30 is disposed between frame portions 11*a* and 11*b* in a plan view.

Furthermore, in the embodiment, first front throttle body 53*a*, first rear throttle body 54*a*, and second rear throttle body 54*b* are connected to each other via casing 70. Therefore, a connecting strength between first rear throttle body 54*a* of first front throttle body 53*a* and second rear throttle body 54*b* is increased. In view of increasing the connecting strength of respective throttle bodies, first and second casing portions 71 and 72 are preferably made of metal.

In the embodiment, an example in which second casing portion 72 is fixed to second rear throttle body 54*b* only is described. However, the invention is not restricted to this structure. Second casing portion 72 may be fixed to second front throttle body 53*b* only or may be fixed to both second front throttle body 53*b* and second rear throttle body 54*b*. This structure allows more effective suppression of vibration occurring in motor 60. Moreover, when casing 70 is made of metal, the connecting strength between first and second front throttle bodies 53*a* and 53*b* and first and second rear throttle bodies 54*a* and 54*b* is further increased.

Meanwhile, in consideration of the durability of throttle body assembly 50, it is important not to cause stress between transmission gear mechanism 62 and casing 70 and valve shafts 65 and 66.

For instance, in the known throttle body assembly 100 of FIG. 13, a portion of casing 105 that houses the transmission gear mechanism and is penetrated by valve shaft 107 is not fixed to any other parts. Accordingly, stress is likely to occur between casing 105 and the transmission gear mechanism and valve shaft 107.

On the contrary, in the embodiment, as shown in FIG. 8, a portion of casing 70 that houses transmission gear mechanism 62 and is penetrated by valve shafts 65 and 66 is directly fixed to first front throttle body 53*a* and first rear throttle body 54*a*. Accordingly, compared with the structure of FIG. 13, stress is less likely to occur between transmission gear mechanism 62 and casing 70 and valve shafts 65 and 66. Therefore, the durability of throttle body assembly 50 is further increased. In view of a further increase of the durability of throttle body assembly 50, it is particularly preferable that second casing portion 72 has a high strength. For example, second casing portion 72 is preferably made of metal.

Furthermore, in the embodiment, a left end portion of second casing 72 is fixed to second rear throttle body 54*b*. In this manner, casing 70 is fixed at both the end portions thereof in the widthwise direction. Therefore, widthwise vibration and oscillation of motor 60 and casing 70 is suppressed and stress between valve shafts 65 and 66 and casing 70 is further suppressed effectively.

In the invention, a material of first and second casing portions 71 and 72 is not particularly restricted. However, from the perspective of reducing the weight of throttle body assembly 50 and engine unit 30, it is preferable that at least one of casing portions 71 and 72 is made of resin. With a view to reducing the weight of engine unit 30, it is more preferable that both casing portions 71 and 72 are made of resin.

On the other hand, with a view to increasing the durability of throttle body assembly 50, it is preferable that at least one of casing portions 71 and 72 is made of metal. It is more preferable that both casing portions 71 and 72 are made of metal.

For example, when both casing portions 71 and 72 are made of resin, the weight of casing 70 is reduced but the strength of casing 70 is reduced significantly. On the other hand, when both casing portions 71 and 72 are made of metal, the strength of casing 70 is increased but the weight of casing 70 is increased.

Therefore, in view of achieving both weight reduction and strength increase of casing 70, it is preferable that one of casing portions 71 and 72 is made of metal while the other is made of resin.

When one of casing portions 71 and 72 is made of metal and the other is made of resin, it is particularly preferable that first casing portion 71 is made of metal. First casing portion 71 houses transmission gear mechanism 62. Therefore, when the strength of first casing portion 71 is insufficient, transmission gear mechanism 62 is subjected to a significant load. On the other hand, second casing portion 72 houses motor 60. Transmission gear mechanism 62 is connected to valve shafts 65 and 66 whereas motor 60 is not directly connected to other members except casing 70. Therefore, second casing portion 72 suffices as long as it has sufficient strength to hold motor 60. That is, while a relatively high strength is required for first casing portion 71, such a great strength is not required for second casing portion 72. It is therefore particularly preferable that first casing portion 71 is made of metal while second casing portion 72 is made of resin.

For example, in a case in which first and second front throttle bodies 53*a* and 53*b* and first and second rear throttle bodies 54*a* and 54*b* are not mutually fixed, the mutual positions of throttle bodies 53*a*, 53*b*, 54*a*, and 54*b* may change due to vibration of engine 31 and vibration and oscillation caused during driving. In this case, stress is applied to casing portion 72 that is fixed to at least three throttle bodies of the four throttle bodies 53*a*, 53*b*, 54*a*, and 54*b*. As a result, there is a risk that the durability of transmission gear mechanism 62 is reduced.

On the other hand, in the embodiment, the four throttle bodies 53*a*, 53*b*, 54*a*, and 54*b* are mutually fixed by connecting member 85. Therefore, a change in the mutual positions of throttle bodies 53*a*, 53*b*, 54*a*, and 54*b* can be suppressed and stress applied to casing 70 reduced. As a result, the load applied to transmission gear mechanism 62 is reduced.

Furthermore, since the stress applied to casing 70 can be reduced by providing connecting member 85, the strength required for casing 70 can be reduced. Therefore, when at least one of casing portions 71 and 72 is made of resin, it is preferable to provide connecting member 85 as in the embodiment. Moreover, even when casing portions 71 and 72 are made of metal, casing portions 71 and 72 can be made thin. As a consequence, weight reduction of casing 70 is achieved.

In view of securely and mutually fixing the four throttle bodies 53*a*, 53*b*, 54*a*, and 54*b*, it is preferable as in the embodiment to provide first and second inner connecting pipes 86*a* and 86*b* and first and second outer connecting pipes 87*a* and 87*b*, and also to mutually fix first inner connecting pipe 86*a* and second inner connecting pipe 86*b*. In this manner, by fixing the four throttle bodies 53*a*, 53*b*, 54*a*, and 54*b* by the four connecting pipes 86*a*, 86*b*, 87*a*, and 87*b*, the connecting strength of the four throttle bodies 53*a*, 53*b*, 54*a*, and 54*b* is further increased.

In addition, in view of increasing the connecting strength of front throttle bodies 53*a* and 53*b* and rear throttle bodies 54*a* and 54*b*, it is preferable to provide fixing members 88*a* and 88*b* that fix front throttle bodies 53*a* and 53*b* and rear throttle bodies 54*a* and 54*b* at four points. In this manner, by providing the four connecting pipes 86*a*, 86*b*, 87*a*, and 87*b* as well as fixing members 88*a* and 88*b*, the connecting strength of the four throttle bodies 53*a*, 53*b*, 54*a*, and 54*b* is particularly increased.

In the embodiment, second casing portion 72 and second rear throttle body 54*b* are fixed by stay 67. Therefore, regardless of a shape of second casing portion 72 and a positional relationship of second casing portion 72 and second rear throttle body 54*b*, second casing portion 72 and second rear throttle body 54*b* can be fixed easily. Furthermore, by utilizing stay 67, a fixing operation of second casing portion 72 and second rear throttle body 54*b* becomes easier.

As shown in FIG. 8, it is preferable to fix, by stay 67, second casing portion 72 with one of second front throttle body 53*b* and second rear throttle body 54*b*, whichever is located farther from second casing portion 72. For instance, in a case in which second casing portion 72 is fixed, by stay 67, to second front throttle body 53*b* which is relatively close to second casing portion 72, a length of stay 67 can be shortened. In this case, however, the arrangement and installation operation of stay 67 become difficult. Therefore, it is preferable to fix, by stay 67, second casing portion 72 and second rear throttle body 54*b* that is arranged relatively apart from second casing portion 72. As a consequence, the arrangement and installation operation of stay 67 become easy.

Modified Example

Figure 11:
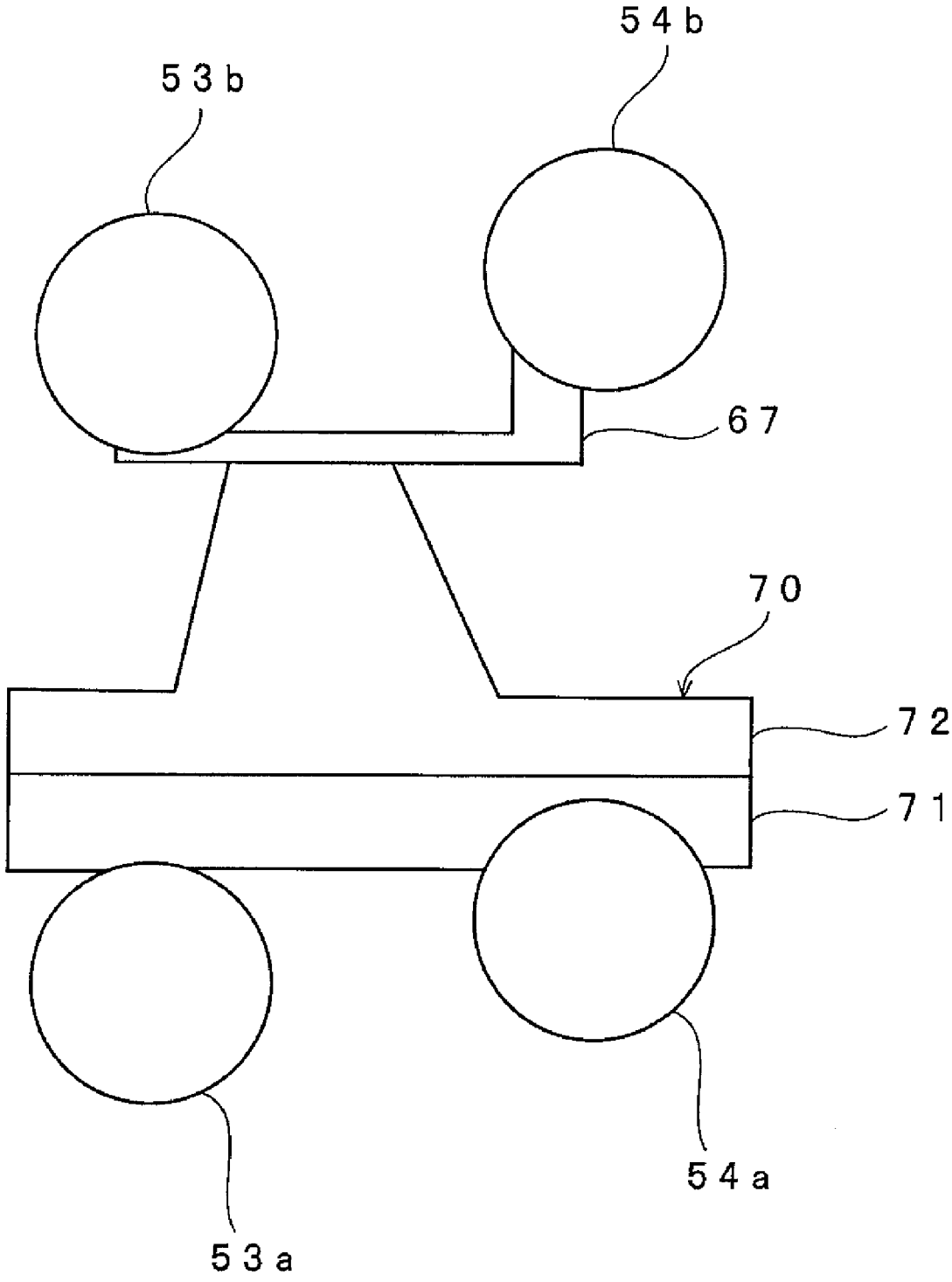
FIG. 11 is a plan view of a throttle body assembly according to a modified example 1.

In the embodiment described above, an example in which second casing portion 72 is fixed only to second rear throttle body 54*b* is described. However, the invention is not restricted to this structure. For instance, as in a modified example 1 shown in FIG. 11, second casing portion 72 may be fixed to both second front throttle body 53*b* and second rear throttle body 54*b* using stay 67.

Figure 12:
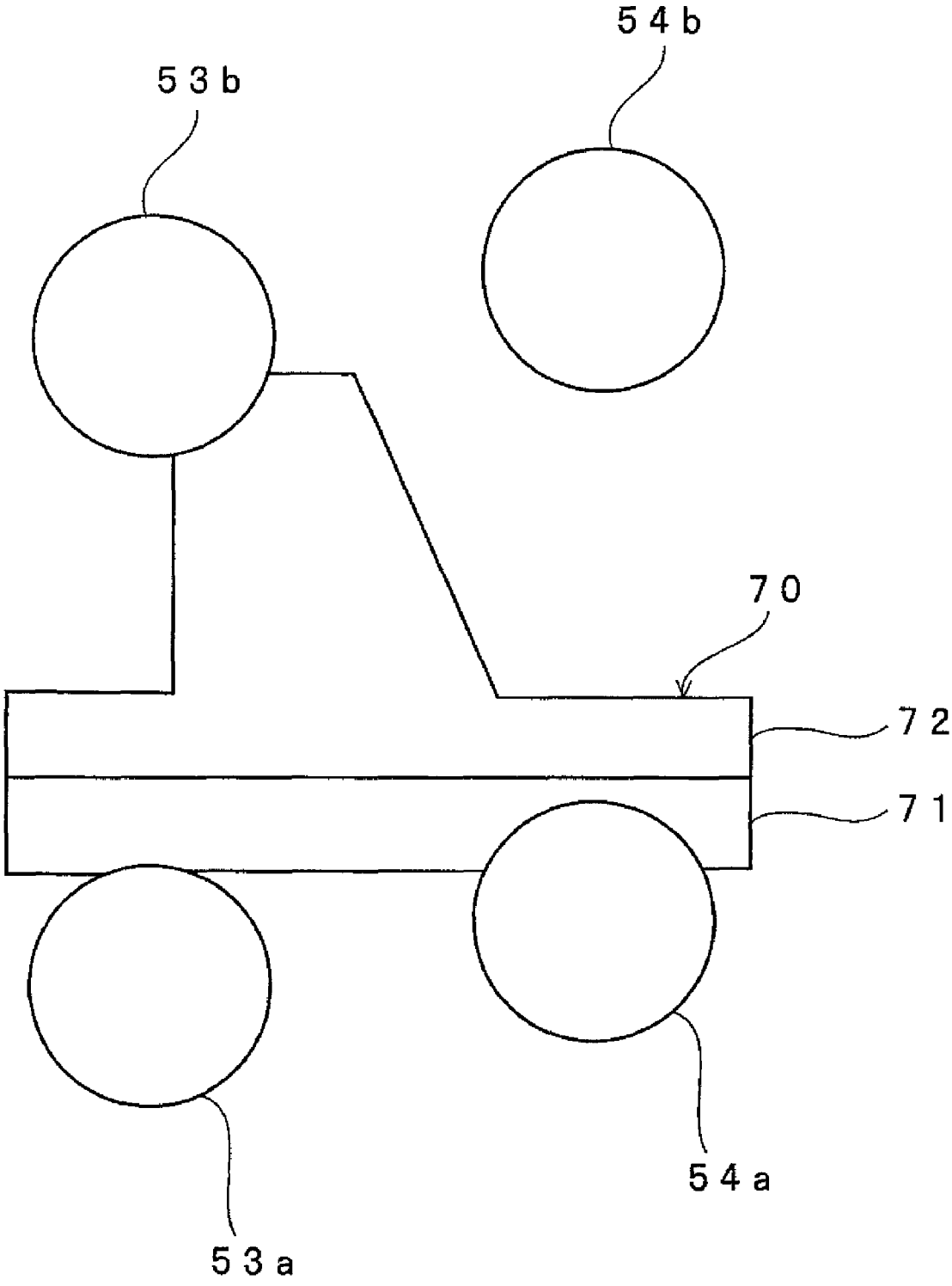
FIG. 12 is a plan view of a throttle body assembly according to a modified example 2.

Moreover, in the embodiment described above, an example in which second casing portion 72 is fixed to stay 67 is described. However, in the invention, the second casing portion may be directly fixed to at least one of the second front throttle body and the second rear throttle body. Specifically, as in a modified example 2 shown in FIG. 12, second casing portion 72 may be fixed to second front throttle body 53*b*.

Furthermore, in the embodiment described above, an example in which throttle body assembly 50 is provided with two front throttle bodies 53*a* and 53*b* and two rear throttle bodies 54*a* and 54*b* is described. However, the invention is not restricted to this structure. The throttle body assembly may be provided with only one front throttle body and one rear throttle body. Moreover, the throttle body assembly may be provided with at least three front throttle bodies and at least three rear throttle bodies. Even in a case in which the throttle body assembly includes only one front throttle body and one rear throttle body, it is possible to securely fix casing 70 at three points.

The invention claimed is:

1. An engine unit including a V-type engine provided with a front cylinder, a rear cylinder, a front intake port connected to the front cylinder, and a rear intake port connected to the rear cylinder, and a throttle body assembly attached to the V-type engine, the throttle body assembly comprising:

a front throttle body having a front cylinder connected to the front intake port and a front throttle valve for opening and closing the front cylinder of the front throttle body;

a rear throttle body having a rear cylinder connected to the rear intake port and a rear throttle valve for opening and closing the rear cylinder of the rear throttle body;

an actuator that, in a longitudinal direction, is disposed between a center axis of the front cylinder of the front throttle body and a center axis of the rear cylinder of the rear throttle body, and drives the front and rear throttle valves;

a transmission gear mechanism that transmits power from the actuator to the front and rear throttle valves; and a casing that houses the actuator and the transmission gear mechanism and the casing includes a first casing portion that is fixed to the front and rear throttle bodies, and a second casing portion that faces the first casing portion in a widthwise direction and is fixed to at least one of the front and rear throttle bodies at positions that are different than positions that the first casing portion is fixed to the front and rear throttle bodies.

2. The engine unit according to claim 1, wherein the front throttle body includes a first front throttle body and a second front throttle body arranged in a widthwise direction, the rear throttle body includes a first rear throttle body and a second rear throttle body arranged in a widthwise direction, the first casing portion is fixed to the first front throttle body and the first rear throttle body, and the second casing portion is fixed to at least one of the second front throttle body and the second rear throttle body.

3. The engine unit according to claim 1, wherein at least one of the first and second casing portions is made of resin.

4. The engine unit according to claim 3, wherein the first casing portion is made of metal and the second casing portion is made of resin.

5. The engine unit according to claim 2, wherein the throttle body assembly further includes a connecting member that mutually connects the first front throttle body, the second front throttle body, the first rear throttle body, and the second rear throttle body.

6. The engine unit according to claim 5, wherein the connecting member includes:

a first inner connecting pipe that is disposed to the rear of center axes of the first and second front throttle bodies, and is fixed to the first and second front throttle bodies;

a second inner connecting pipe that is disposed to the front of center axes of the first and second rear throttle bodies, and is fixed to the first and second rear throttle bodies as well as being fixed to the first inner connecting pipe;

a first outer connecting pipe that is disposed to the front of the center axes of the first and second front throttle bodies, and is fixed to the first and second front throttle bodies; and a second outer connecting pipe that is disposed to the rear of the center axes of the first and second rear throttle bodies, and is fixed to the first and second rear throttle bodies.

7. The engine unit according to claim 6, wherein the connecting member includes:

a first fixing member that is fixed by at least four points at an upper portion and a lower portion of the first front throttle body and an upper portion and a lower portion of the first rear throttle body; and a second fixing member that is fixed by at least four points at an upper portion and a lower portion of the second front throttle body and an upper portion and a lower portion of the second rear throttle body.

8. The engine unit according to claim 2, wherein the throttle body assembly further includes a stay that fixes the second casing portion and at least one of the second front throttle body and the second rear throttle body.

9. The engine unit according to claim 8, wherein the stay fixes the second casing portion and one of the second front throttle body and the second rear throttle body, whichever is arranged at a position farther from the second casing portion.

10. A vehicle provided with the engine unit according to claim 1.

11. The vehicle according to claim 10, wherein the vehicle is a motorcycle further comprising a head pipe, and left and right frames that extend to the rear from the head pipe, and the throttle body assembly is disposed between the left and right frames in a plan view.

12. The engine unit according to claim 1, wherein the first casing portion and second casing portion are directly fixed to each other.

* * * * *